United States Patent [19]

Perazzolo

[11] Patent Number: 4,672,748

[45] Date of Patent: Jun. 16, 1987

[54] PAIR OF TAILORING SET-SQUARES FOR SKETCHING THE COMPONENT PARTS OF CLOTHING ESPECIALLY FOR CONSTRUCTING GARMENTS OF ANY SIZE OR MODEL

[76] Inventor: Guiseppe Perazzolo, Via Francesco Orsoni 54, Bologna, Italy

[21] Appl. No.: 837,651

[22] Filed: Mar. 5, 1986

Related U.S. Application Data

[63] Continuation of Ser. No. 568,501, Jan. 5, 1986, abandoned, which is a continuation of Ser. No. 400,051, Jul. 20, 1982, abandoned.

[30] Foreign Application Priority Data

Jul. 20, 1981 [IT] Italy ..... 4949/81[U]

[51] Int. Cl.[4] ..... A41H 3/00

[52] U.S. Cl. ..... 33/11

[58] Field of Search ..... 33/11–17

[56] References Cited

FOREIGN PATENT DOCUMENTS

| | | | |
|---|---|---|---|
| 48029 | 4/1974 | Australia | 33/11 |
| 953907 | 9/1974 | Canada | 33/12 |
| 1060088 | 11/1953 | France | 33/11 |
| 683417 | 2/1965 | Italy | 33/11 |
| 621247 | 1/1981 | Switzerland | 33/11 |
| 11985 | of 1898 | United Kingdom | 33/11 |

*Primary Examiner*—Harry N. Haroian

*Attorney, Agent, or Firm*—Fleit, Jacobson, Cohn & Price

[57] ABSTRACT

A tailoring device for preparing clothing patterns based upon body measurements, the device provided in the form of a flat, triangular member which includes various scales along its marginal edges. The device also includes a plurality of interiorly arranged apertures of varying shapes, from linear to curvilinear and combinations thereof, the interior openings including scales defined along edge portions thereof and which are utilized in preparing finished patterns. The device can be provided in the form of two separate triangular elements which are hingedly connected along a shorter side of each in order to permit the device to be folded in half for purposes of convenience.

2 Claims, 4 Drawing Figures

PAIR OF TAILORING SET-SQUARES FOR SKETCHING THE COMPONENT PARTS OF CLOTHING ESPECIALLY FOR CONSTRUCTING GARMENTS OF ANY SIZE OR MODEL

This application is a continuation of application Ser. No. 568,501, filed Jan. 5, 1984, now abandoned which is a continuation of Ser. No. 400,051, filed July 20, 1982, now abandoned.

This invention relates to a pair of tailoring instruments for sketching the component parts of any model or size of garments for both men's and ladies' attire.

The invention is the creation of a pair of tailoring instruments suitable for the purpose of simplifying the transfer of body measurements onto the fashion sketch.

Another important aim is to provide a pair of instruments offering a remarkable flexibility of usage aimed at producing sketches concerning various sizes to be used in thr drafting of different patterns such as large-sleeved or narrow-sleeved models, etc.

A further purpose is to produce a pair of instruments whose use is simple, extremely easy, does not involve any mathematical calculation and which enables even persons unskilled in drawing to produce patterns.

These and other aims are achieved by this pair of talloring instruments for sketching the component parts of clothing items of all sizes and models, and is characterized by the fact that it is compresed essentially of right-angled triangular instruments bearing on the side "SCALES" graded and numbered according to sizes marked with the indication of each part of the garment to be crafted. Additionally, the above mentioned instruments have slits carved internally presenting a curvature and/or outlines (matching with a part of the curvature of the clothing items to be sketched) also endowed with numbers and gradings related to measurements gathered from the person.

Further particulars will become clearer and more evident from the detailed description illustrated in the included drawings in which.

With particular reference to the cited FIGURES we have: two devices 102' and 101 each formed by the union (through hinges numbered 103 and 104) of couples of semi-instruments 101*a*, 101*b*, 102*a*, 102*b*, each of which also conforms to an isosceles right-angled triangle.

Figures 1, 2:
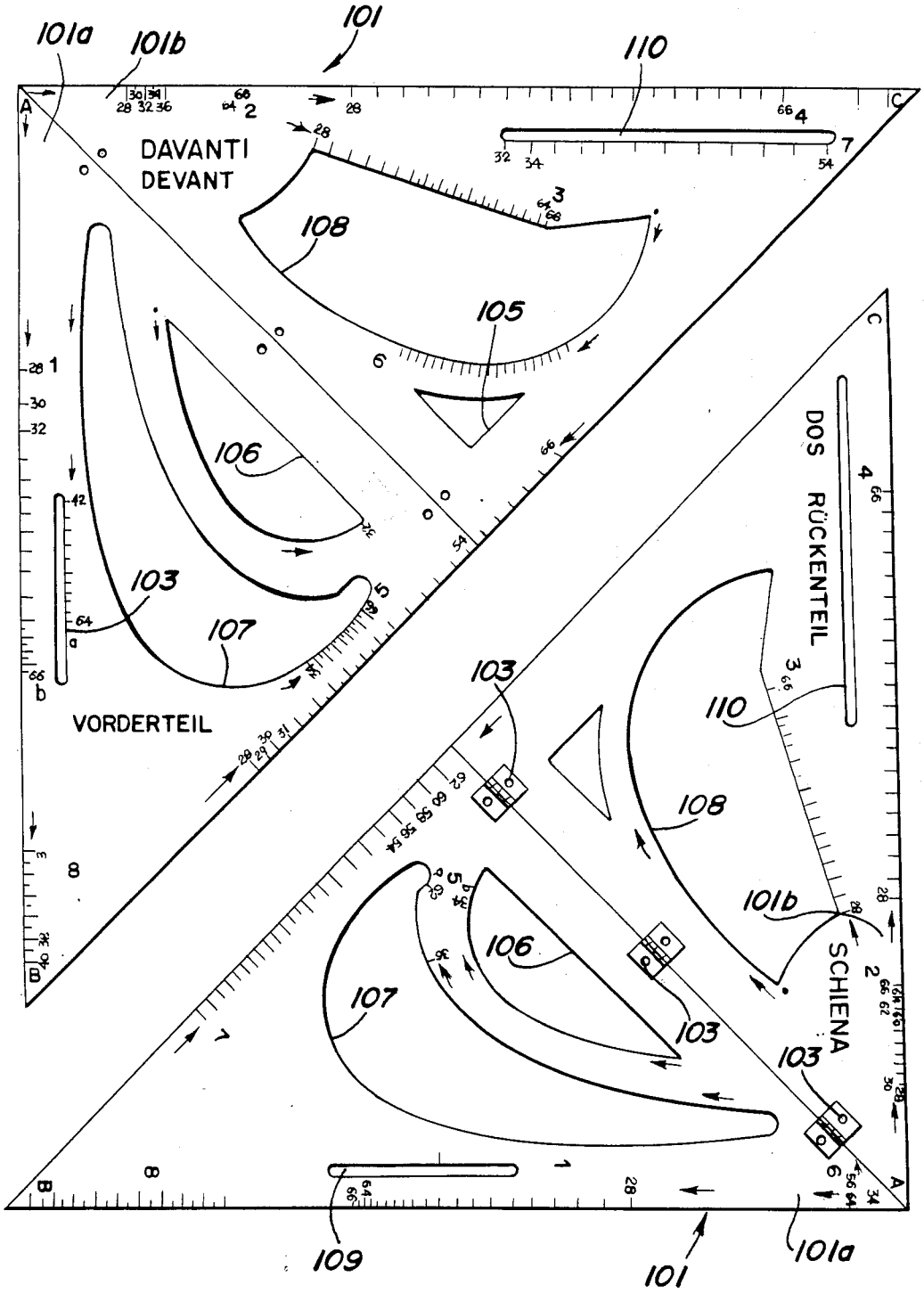
FIG. 1 is a front view of the first triangular device
FIG. 2 is a back view of same.

Device 101 (formed by coupling semi-instruments 101*a* and 101*b* through hinges 103) presents openings 105, 106, 107, 108, 109 and 110 the first of which simply serves to lighten the device. On the obverse of this instrument 111 (represented in FIG. 1) and on whose vertices are marked A, B, C, there are scales bearing the numbers 1*a*, 1*b*, 2, 3, 4, 5, 6, 7, 8, 9. The scales bearing 1*b*, 2, 4, 8, 9 are placed along the margins of the instrument; the scales 1*a*, 7 are along the slits 109 and 110 parallel to the sides of the device; scale No 5 is placed on a segment of the marginal curve of opening 107 and the remaining two (scales 3 and 6) are on segments of the margin of slit 108. On this side of this instrument the word FRONT written in several languages is visible.

Figures 3, 4:
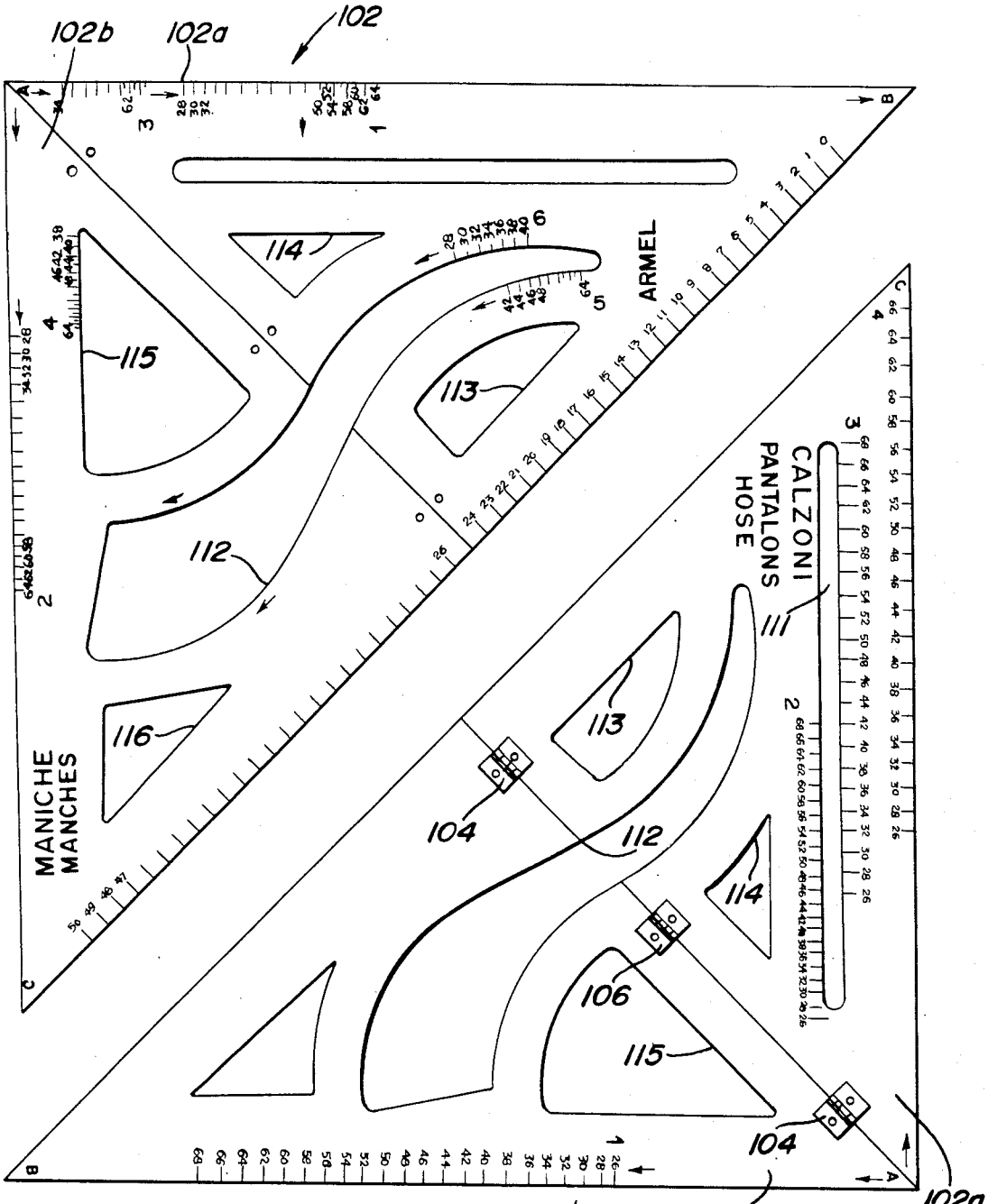
FIG. 3 is a view of the front side of device number 2.
FIG. 4 is a view of the reverse side of the same device number 2.

On the reverse (FIG. 2) of the same instrument 101 appears the word BACK and there are scales 1, 2, 4, 7, 8 traced along the edges of the instrument, scales 3, 5*a* and 5*b* on segments of the delimitation curves of openings; 108, 106 and 107, respectively. On the FRONT side of INSTRUMENT No. 2 (FIG. 3) formed by semi-instruments 102*a* and 102*b* held together by hinges 104, the vertices are indicated by A, B, C.

Instrument 102 includes openings 111, 112, 113, 114, 115, 116; openings 113, 114, 116 lighten the instrument while the others have parts at least of their marginal curves matching parts of clothing items to be sketched. In particular, on a side of this instrument appears the word SLEEVES written in several languages (FIG. 3) as well as a graduated scale marked with the FIGS. 2, 1 disposed along the sides; another scale directed leftwards, graded in centimeters along the hupotenuse, the scales 4 along a portion of the curvature of slit 115 and the scales 5 and 6 along two tracts of the curvature of slit 112.

On the reverse of instrument 102 (FIG. 4) appears printed the word PANTS (SLACKS) in several languages as well as A, B, C on the vertices. Along the sides of this instrument are the scales 1 and 4 while on both sides of slit 111 are printed scales 3 and 4 disposed parallel to sides AB.

The above-mentioned graduated scales marked on the surfaces of the instruments bear the following words engraved in several languages: (FIG. 1) SCALE 1*a*: ABBASSAMENTO GIRO (ARMHOLE'S LENGTH) 2: NECK'S POSITION; 3: SHOULDER LINE; 4: BUSTLINE HEIGHT; 5: ARMHOLE'S LINE. On the curve of cleft 106: SMALL ARMHOLE; 6: NECKLINE; 7: FOR SKETCHING MEN'S TYPE JACKET; WAISTLINE GIRTH. (FIG. 2) SCALE 1: ARMHOLE'S LENGTH; 2: NECK'S POSITION; 3: SHOULDER LINE; 4: BUSTLINE HEIGHT; 5: ARMHOLE's LINE; 6: SMALL ARMHOLE; 7: HALF WAIST GIRTH.

(FIG. 3) SCALE 1: ARMHOLE LENGTH; 2: SLEVE GIRTH;
3: NO INDICATION
4: HALF SLEEVE GIRTH
5: SLEEVE CAP CURVE
6: SMALL SLEEVE CAP CURVE.

(FIG. 4) SCALE 1: CROTCH LENGTH;
2: CREASE POSITION
3: ¼ Hipline
4: CROTCH START ON WAISTLINE.

A number of the scales as illustrated in FIGS. 1 through 4 progress uniformly in that there are uniform spacings between adjacent scale divisions for equal numerical differences between those scale divisions. However, in the device illustrated in FIGS. 1 and 2, the sleeve length, the half waist girth, and the shoulder line scales are non-uniform. Similarly, in the device illustrated in FIGS. 3 and 4, the sleeve girth, the sleeve length, and the sleeve cap curve scales are non-uniform.

Here follows the use of the instruments in accordance with the invention. Take the personal measurements corresponding to the hip, bust, waist lines, arm length and skirt length. The waist, bust and hip measurements must be halved since they are considered to be made-up of two separate pieces FRONT and BACK.

With these measurements the "basic sketch" lacking any fold and/or decorative span can be developed. The basic sketch is then modified according to models.

Use instrument 101 to initiate the sketching of the front part of the corset. Place it on paper with the AB vertical and the word FRONT in view.

Using the instruments draw two lines perpendicular to each other, the horizontal one up to the HALF BUST SIZE of the person for whom the dress is being made.

Extend the vertical line up to the waistline length (on scale 8). Mark the HALF BUST MEASUREMENT point on scale 1*b* and on scale 3 of cleft 108. Slide the instrument along the drawn line till the vertex A reaches the noted point on scale 1*b*.

Draw another horizontal line from this point up to the same value on scale 4 corresponding to the HALF BUST MEASUREMENT.

With the contoured portion of scale 5 on slit 107 passing through the point marked using scale 3, let it coincide with the end of the new horizontal line.

Draw the curve joining the two points corresponding to the ARM SIZE then link the end of this curve with the extremity of the first horizontal line.

Superimpose the HALF BUST MEASUREMENT point (scale 6, slit 108) on the crossing point of this line with the first horizontal line. Make it coincide with the vertical line previously drawn then sketch the neckline curve.

From the end of the vertical line drawn earlier (with the help of the hypotenuse AC of the instrument sketch a horizontal line equal to the HALF BUST MEASUREMENT. Link the extremity of this horizontal line with that of the second horizontal, thus completing the sketch of half the front and if the cloth is folded, the entire bodice front. The sketching of the back half is done with the reverse of the same instrument 101 (FIG. 2) following a similar procedure. Place the side AB vertically, draw a ling along AB and mark the points corresponding on scales 1, 2, 3, 6 to the HALF BUST MEASUREMENT and on scale 8 the waistline length. Proceed as described for the front using in succession scales 4, 5*a* or 5*b*, BACK NECKLINE, 7. As suggested from these basic sketches with appropriate transfers and redrawings, it is possible to make any desired variant of the model bearing in mind that once this variation is carried out, the item must fit since it has been made to specific measurements. Using instrument 102, the SLEEVE BASIC SKETCH is obtainable in a similar manner.

Place the side marked AB vertically over a previously drawn line equal in length to the projected sleeve with the vertex A on the extremity.

Mark the point corresponding to the HALF BUST MEASUREMENT on scale slide the instrument along the line until its vertex coincides with the point. Then mark the analogous point of scale 2 drawing the relative perpendicular. Unite the extremity of the first line with the end of the perpendicular using the marginal curve of the slit bearing scale 5 or 6 by making the extremity of the first line coincide with the point of the same scale 5 bearing the HALF BUST MEASUREMENT.

With the curved ruler (or using part of scales 5 or 6 draw the ARMHOLE LINE completing the sketch according to the desired model with simple straight lines and the sleeve cap curve. Use the reverse of the same instrument 102 (FIG. 4) to sketch the component parts of pants or slacks. The measurements needed are HALF HIPLINE MEASUREMENT, HALF WAISTLINE MEASUREMENT, PANTS LENGTH (EXTERNALLY), INTERNAL LEG LENGTH.

Draw two perpendicular lines, the vertical one up to the scale 1 point indicating the HALF HIPLINE MEASUREMENT and the horizontal line up to the same indication along scale 4.

Mark the same points on scales 2 and 3 of cleft 31. Thus all significant points relative to the sketch of the upper parts of the pants are marked.

To complete the sketch, draw a rectangle with sides formed by joining the marks taken using scales 1 and 4, then draw two vertical lines passing through the points marked using scales 2 and 3.

Prolong the scale 3 line downwards as long as the projected pants; departing from this line, draw the other lines extending outwards on both sides equal to the width of the pants to be obtained.

From this basic sketch vary with curves according to the model desired.

It is thus evident how the device attains its aims, and particularly how it enables what making of basic sketches of the various components of any item of clothing no matter what size.

The device so conceived is susceptible to numerous alteration and variants, all falling within the inventive concept. For instance the curves of the various clefts could be different. Besides, all the details can be substituted by others technically equivalent. Practically all the material used as well as the shapes and sizes can vary according to need without deviating from the sphere of protection of the following conditions and revendications.

What is claimed is:

1. A tailoring instrument for sketching the component parts of garments based upon body measurements, said instrument comprising: a triangular instrument in the form of an isosceles right triangle defined by a pair of equally sized right isosceles triangles hingedly connected along respective shorter legs thereof, each of said shorter legs defined by the altitude of said instrument, said instrument having first and second linear perpendicular legs of equal length and a third linear leg extending between and interconnecting outer ends of each of said first and second legs, each of said legs carrying scale indicia corresponding to body measurements on both sides thereof and positioned along outer edges thereof, said first leg including a first scale on first and second sides thereof and extending along the outer edge thereof having scale indicia corresponding with sleeve length and a second scale on said first and second sides thereof and extending along said outer edge thereof having scale indicia corresponding with waistline length, said second leg including a first scale on first and second sides thereof and extending along the outer edge thereof having scale indicia corresponding with neck position and a second scale on said first and second sides thereof and extending along said outer edge having scale indicia corresponding with bustline height, said third leg including a waistline measurement scale on one side and extending along an outer edge thereof having scale indicia corresponding with a first fraction of waistline length, said third leg including a waistline measurement scale on a second side thereof and extending along substantially one-half of the outer edge of said third leg and having scale indicia corresponding with a second fraction of waistline length different from said first fraction, said instrument including a plurality of interiorly positioned openings disposed on opposite sides of the altitude of said triangle and spaced therefrom, said interior openings bearing scale indicia along their edges, one of said interior openings including a linear edge disposed obliquely relative to each of said legs of said instrument, said linear edge having scale indicia positioned therealong on both sides of said instrument corresponding with shoulder width, said one interior opening including a curved edge having scale indicia positioned therealong on both sides of said instrument corresponding with neckline size, a second of said interior openings including a curved edge having scale indicia positioned therealong corresponding with sleeve length, and first and second elongated linear slots having scale indicia along an inner linear edge thereof on one side of said instrument, each of said linear slots having an inner linear edge and an outer linear edge disposed parallel to and inwardly of respective outer edges of said first and second legs, one of said slots having scale indicia corresponding with waistline girth positioned along said inner linear edge thereof and the other of said slots having scale indicia corresponding with sleeve length positioned along said inner linear edge thereof, and at least one of said scales along said slots having a non-uniform scale progression.

2. A tailoring instrument for sketching the component parts of garments based upon body measurements, said instrument comprising; a triangular instrument in the form of an isosceles right triangle defined by a pair of equally sized right isosceles triangles hingedly connected along respective shorter legs thereof, each of said shorter legs defined by the altitude of said instrument, said instrument having first and second perpendicular linear legs of equal length and a third linear leg extending between and interconnecting outer ends of each of said first and second legs, each of said first and second legs carrying scale indicia corresponding to body measurements on both sides thereof and positioned along outer edges thereof, said first leg including a first scale along the outer edge thereof and on one side thereof, said scale defined by scale indicia corresponding with sleeve girth and on the other side of said first leg a second scale along the outer edge thereof having scale indicia corresponding with crotch length, said second leg including a first scale along the outer edge thereof and on one side thereof, said scale defined by scale indicia corresponding with sleeve length and on the other side of said second leg a second scale along the outer edge thereof having scale indicia corresponding with crotch length, said instrument including a plurality of interiorly positioned openings bearing scale indicia along their edges, one of said interior openings including a linear edge parallel to the outer edge of said first leg and having scale indicia therealong corresponding with half sleeve girth, a second of said interior openings in the form of an elongated linear slot having an inner linear edge and an outer linear edge, each of said linear edges having scale indicia along edges thereof on one side of said instrument, said linear slot disposed parallel to and inwardly of the outer edge of said second leg and having scale indicia along one edge of said slot corresponding with crease position and having scale indicia along the other edge thereof corresponding with a hipline measurement, and a unitary interior opening defined by a pair of curved edges of generally S-shape and spaced from each other, one of said curved edges including scale indicia defining a sleeve cap curve scale, the other of said curved edges including scale indicia defining a small sleeve cap curve scale thereon, said unitary curved interior opening having its S-shaped curved edges extending across the altitude of said triangular instrument, and at least one of said scales along said S-shaped curved edges having a non-uniform scale progression.

* * * * *